United States Patent [19]

Gordon et al.

[11] Patent Number: 4,813,546

[45] Date of Patent: Mar. 21, 1989

[54] OPENING ARRANGEMENT FOR GABLE TOP CONTAINER

[75] Inventors: Robert L. Gordon, Monroe; Roderick W. Kalberer, Salisbury Mills, both of N.Y.

[73] Assignee: International Paper Company, Purchase, N.Y.

[21] Appl. No.: 206,798

[22] Filed: Jun. 15, 1988

[51] Int. Cl.[4] ..... B65D 5/70

[52] U.S. Cl. ..... 206/621.2; 206/631.2; 229/125.42

[58] Field of Search ..... 229/125.42; 206/625, 206/622, 621, 621.3, 621.2, 621.1, 631.3, 612, 611, 608, 605, 604, 601

[56] References Cited

U.S. PATENT DOCUMENTS

| | | |
|---|---|---|
| 1,157,462 | 10/1915 | Wormer . |
| 3,167,232 | 1/1965 | Partridge . |
| 3,178,089 | 4/1965 | Tobias . |
| 3,178,091 | 4/1965 | Tobias . |
| 3,183,800 | 5/1965 | Farrell . |
| 3,232,514 | 2/1966 | Swede . |
| 3,252,385 | 5/1966 | Balocca . |
| 3,339,820 | 9/1967 | Krzyzanowski . |
| 4,327,833 | 5/1982 | Kuchenbecker . |
| 4,362,245 | 12/1982 | Kuchenbecker . |
| 4,546,884 | 10/1985 | Kuchenbecker . |

*Primary Examiner*—David T. Fidei
*Assistant Examiner*—Jes F. Pascua
*Attorney, Agent, or Firm*—Walt Thomas Zielinski

[57] ABSTRACT

A gable top carton and a blank for forming it. The upstanding fin at the top of the gable includes two fin forming protions or extensions from each gable panel laminated together. Half of the length of each fin forming gable panel portion is provided with a horizontally extending tear line and also with a plurality of vertically extending cut lines at its midportion, the latter functioning as tear lines. To open the carton, the midportion of the upper edge of the fin is ripped downwardly and thereafter half of the fin removed by also tearing along the horizontal tear lines, to thus open half of the carton top for manual pour spout formation by the consumer. By virtue of the plurality of vertical cut lines on each gable panel fin portion, the initial vertical ripping can take place along respective non-corresponding (non-homologous) vertical cut lines in each of the two fin forming gable portions, thus compensating for any edgewise misalignment of the gable panel fin portions. The carton interior is internally coated with a barrier layer material, as conventional, but the several cuts through the paperboard and the external PE coating do not extend through the barrier layer, thus preserving the contamination inhibiting property of the barrier layer.

6 Claims, 3 Drawing Sheets

OPENING ARRANGEMENT FOR GABLE TOP CONTAINER

BACKGROUND OF THE INVENTION

This invention relates to cartons or containers and more particularly to a gable top container. Such containers are usually fashioned from a unitary blank of paperboard or other resilient, stiff and foldable sheet material, usually plastic coated on both the inside and outside forming surfaces. A carton is made from a blank by scoring the latter to define fold lines or axes and then folding, forming and sealing it into a tube like structure, with one end, usually the bottom, then being closed and sealed. Thereafter, a foodstuff to be packaged, such as milk or fruit juice, is poured into the open end of the container and the container thereafter sealed at the top by infolding the top closure panels and sealing certain surfaces of these panels by means of heat and pressure to partially melt the polyethylene coating on the paperboard, the polyethylene thus also functioning as an adhesive.

The upper end of the usual milk or juice containing gable top container includes a ridge or fin, lying in a vertical plane, the fin formed by the lamination together of the uppermost portions of the two infolding or gusset panels and the uppermost portions of the two gable panels. The upper portion of the gable panels forms the two outermost fin forming panels, while the upper portions of the gusset panels form the two innermost fin layers. At the middle of the fin, where the two gusset folds oppositely meet each other, the effective thickness of the fin may be considered as of only two layers, these being the gable panel upper portions. For the opening of most types of gable top containers, the user, with the thumbs, pulls apart an inverted V-shaped opening at one upper side of the container, causing separation of certain seams, and then pushes inwardly on the sides to form the usual pour spout from one of the infolding panels, the latter having been provided with an adhesive to prevent a fiber tearing bond between the spout lip forming surfaces of the pour spout. With this type of opening arrangement or construction, proper alignment between the two outermost fin forming portions of the gable panels is not critical. In certain types of containers however, such as the extended shelf life foodstuff containers of this invention, an adhesive cannot be used.

In a different type of gable top container, opening is effected by the provision of aligned vertically extending tear lines in the upstanding fin (the latter having only two layers instead of the usual four), the lower edge of these tear lines meeting horizontally extending perforations on lower gable panel portions, at the base of the fin. Such a construction is shown in U.S. Pat. No. 3,339,820 issued to Krzyzanowski. If the sheet material from which the carton is formed is relatively thin, any misalignment occurring between the two outermost fin forming panels (each carrying its own vertical tear line) at the time the fin is formed by lamination, is not particularly critical. Vertical tearing can be initiated and take place.

However, if relatively thick paperboard is employed to form the carton, proper alignment of the fin forming upper portions of the gable panels becomes critical. Namely, unless properly aligned, the vertical tear line of one fin forming portion will not be properly aligned with the counterpart tear line on the other fin forming portion. In such a case, opening will become difficult if not impossible.

Misalignment between the fin forming portions of gable panels often occurs due to the difficulty of closing and sealing a filled container consistently the same way with existing top forming machinery.

SUMMARY OF THE INVENTION

According to the practice of this invention, the fin of a gable top carton is provided with an initial opening arrangement to accommodate edgewise misalignment of the fin forming panels. This is carried out by providing, instead of a single one, a plurality of vertically disposed tear or cut lines on each of the two outermost fin forming panel portions. These latter portions are of greater vertical extent or height than the corresponding gusset panels. When the fin forming panel portions are adhered together, during the final sealing of the carton top, relatively easy opening can be realized by the consumer, notwithstanding any edgewise misalignment. By virture of having a plurality of vertically disposed tear lines in each of the two outermost fin forming gable panel portions, vertical tearing can commence along one of the tear lines in one of the outermost fin layers and along a non-homologous tear line on the other outermost fin layer. This effectively compensates, vis-a-vis vertical tearing, for misalignment between the fin forming upper gable panel portions.

DETAILED DESCRIPTION OF THE INVENTION

Figure 1:
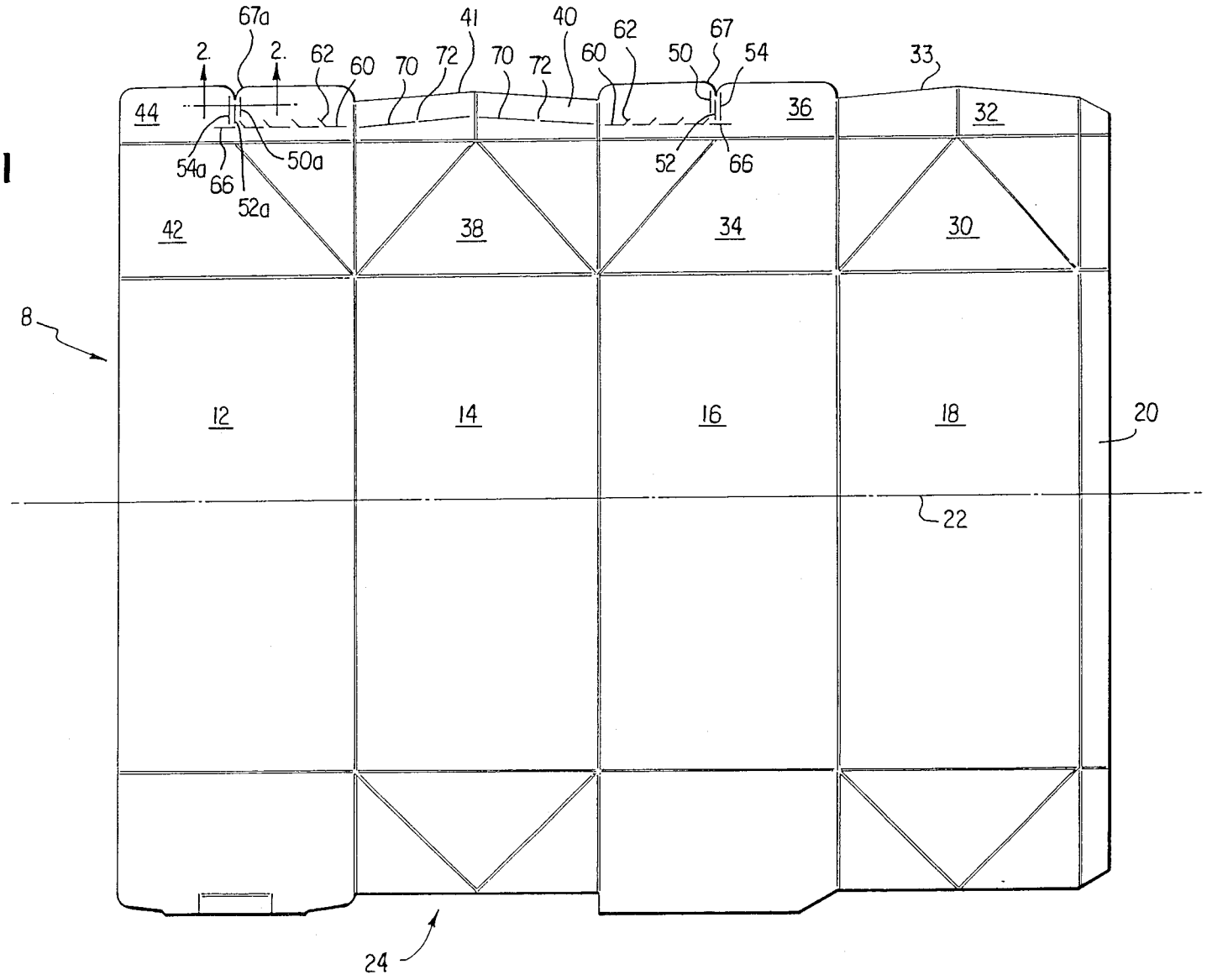
FIG. 1 is a plan view of a unitary blank from which the carton of this invention is formed.
Figure 2:
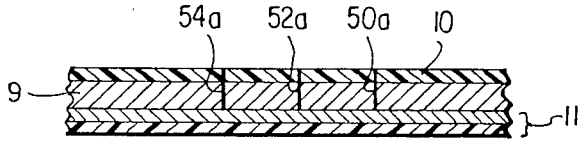
FIG. 2 is a view taken along section 2—2 of FIG. 1.

Referring now to FIGS. 1 and 2 of the drawings, the numeral 8 denotes a unitary blank fashioned from paperboard 9. The paperboard is coated, typically, on its outside surface (towards the viewer in FIG. 1) with polyethylene 10. The interior of the paperboard (away from the viewer) is coated with one or more layers of a barrier layer material, such as a laminate 11 including aluminum foil and various layers of plastic materials, the exact structure and composition of which form no part of this invention. The provision of the paperboard with these coatings may be done either prior to or subsequent to the complete formation of the blank, i.e., its provision with fold defining score lines and cuts.

The numerals 12, 14, 16 and 18 denote serially arranged side forming panels defined by the indicated score lines, with panel 20 being a side seam or manufacturer's flap. The numeral 22 denotes the longitudinal axis of the blank and it is seen that each of the panels is generally rectangular, with its respective longitudinal axis at right angles to longitudinal axis 22. As viewed in FIG. 1, the upper portion of the blank or of any panel or panel portion thereof lies above axis 22 with the lower portion of any panel or portion thereof lying below this axes.

The numeral 24 denotes a plurality of bottom forming panels, integral with their respective side forming panels. The indicated shape and score line arrangement in these bottom panels may be regarded as conventional in the sense that they form no part of this invention.

Referring now to the top closure panels, the numeral 30 denotes a first infold or gusset panel having an upper portion 32 and an upper edge 33. The numeral 34 denotes a first gable panel having an upper portion 36. The numeral 38 denotes a second gusset or infold panel having an upper portion 40 and an upper edge 41. The numeral 42 denotes a second gable panel having an upper portion 44. The infolding and the gable panels are interdigitated, i.e, are alternately positioned relative to each other.

Referring now to upper gable panel portions 36 and 44, panel portion 44 is provided with three vertically disposed cut or tear lines 50*a*, 52*a* and 54*a*. These cut lines commence slightly below the upper edge of this panel portion and extend to a point substantially midway down thereof. Cut lines 50*a*, 52*a* and 54*a* extend through the outer polyethylene layer 10 and through the paperboard 9 and up to, but not through, the barrier layer 11 on the interior forming surface of the carton blank. This is shown at FIG. 2. Similarly, panel portion 36 of gable panel 34 also is provided with a plurality of vertically extending cut lines, similarly disposed, being of the same relation to the coatings, and being designated by 50, 52, and 54. Cut lines 50 and 50*a* are homologous, as are 52 and 52*a*, as are 54 and 54*a*, in the sense that if the fin forming panel portions 36 and 44 are perfectly edgewise aligned after fin formation, cuts 50 and 50*a* will be aligned, as will 52 and 52*a* and 54 with 54*a*.

Substantially one-half of each upper gable panel portion is provided with a series of substantially longitudinally or horizontally extending cuts 60, 62, with the numeral 60 denoting a horizontal portion and the numeral 62 a slanted portion of each. These are termed tear edge perforations. At the central part of each of the respective panels 36 and 44, a horizontal cut line 66 is provided, the purpose of which is to limit vertical tearing.

Referring now to the upper portion of infold or gusset panel 38, panel portion 40 is provided with cut line segments denoted by the numeral 70, separated by gaps 72. The cut lines extend nearly to the indicated vertically extending fold line in the middle of this panel portion, and nearly to the edge of the indicated fold lines. Segments 70 are slightly tilted, as shown, to form an inverted V-shape of very short height.

The height of upper gable panel portions 36 and 44 is greater than the height of gusset panel portions 32 and 40, so that upon final closure of the carton after filling it, the fin portions which require vertical ripping to initially open the carton are of only two thicknesses. The reader will note that the height of the ends of tear lines 60, 62 of the gable panel panels is the same as the height of the adjacent ends of cut lines 70.

Figure 3:
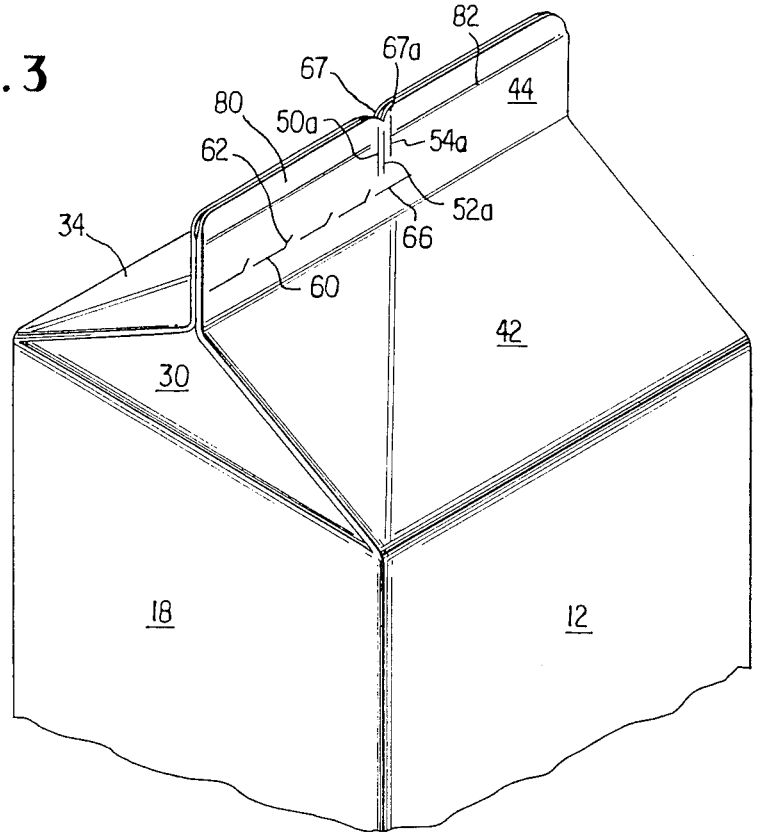
FIG. 3 is a perspective view of the upper portion of a carton formed from the blank of FIG. 1 after filling and sealing.

Referring now to FIG. 3 of the drawings, the upper portion of an erected, filled and closed carton is shown. The relation between the infolded gusset panels and the gable panels is conventional, as may be seen at FIG. 2 of U.S. Pat. No. 3,178,089 issued to Tobias et al.

The carton contains, typically, milk or a fruit juice, and has been formed by first folding it and glueing it (using the polyethylene 10 when heated as an adhesive) into shape of a tube, then closing and sealing the lower end by means of the bottom panels 24, then filling the carton with a liquid or other foodstuff, and then bending and sealing the top closure panels to form the gable top. Those portions of panel portions 32,36,40,44 which are above the level of cut lines 60 and 70 are heat sealed together. When closed, the inner and outer surfaces of 32 and 40 and the two inner surfaces of 36 and 44 are sealed together. The two outer fin forming layers from upper panel portions 36 and 44 are heat sealed together along the entire width of the fin and from the fin top edge to the upper edges 33 and 41 of, respectively, gusset panels 32 and 40. Leakage of any liquid in the container through all of the cut lines is prevented by the barrier layer extrusions 11, see FIG. 2. The seal between the two outermost and uppermost fin layers (36 and 44) is denoted by 80 at FIG. 3, with the numeral 82 denoting the commencement of the fin portion of four thicknesses of the blank below that region. The four layers of sheet material are also sealed serially together (laminated) in the area above the level of cut lines 60 and 66 as shown at FIG. 3.

Figure 4:
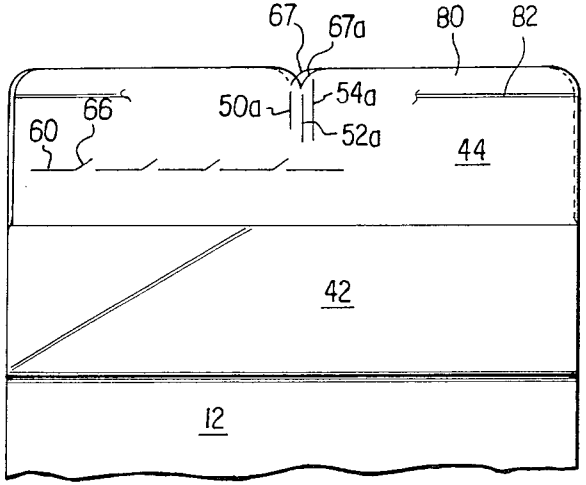
FIG. 4 is a front elevational view of the upper part of the carton of FIG. 3.
Figure 5:
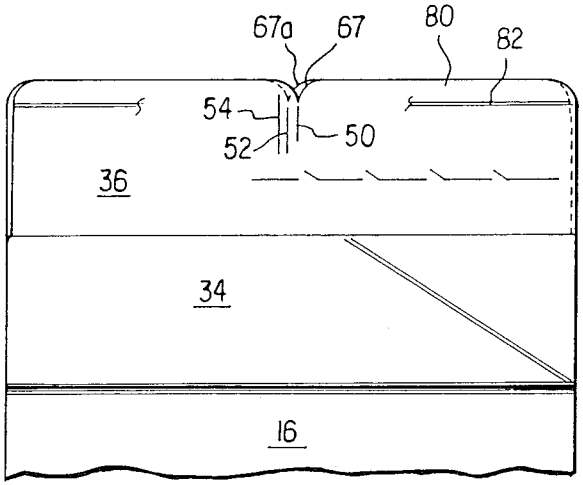
FIG. 5 is a rear elevational view, similar to FIG. 4.

In FIGS. 3 to 5, a typical misalignment situation is illustrated. Namely, the end edges of gable top panel portions 36 and 44 are not perfectly aligned. Thus, the vertical starting tear notches 67 of portion 36 and 67*a* of portion 44 are not perfectly aligned. If only a single vertical cut line in each panel portion 36 and 42 had been provided, such as, respectively, cut lines 52 and 52*a*, then these cut lines would not be aligned. In the event of relatively thick material of about 0.018 to 0.030 inches thick from which the carton is formed is employed, opening would be difficult and usually impossible unless the alignment is perfect. However, tearing in a vertical direction and subsequent opening is possible even with misalignments as much as two thicknesses of the blank, by virtue of this construction, because tearing can take place along any one of the vertically disposed cuts 50, 52 and 54 of panel portion 36 in conjunction with a respective homologous (in the case of alignment) or non-homologous vertical cut line 50*a*, 52*a* and 54*a* of panel portion 44.

Figure 6:
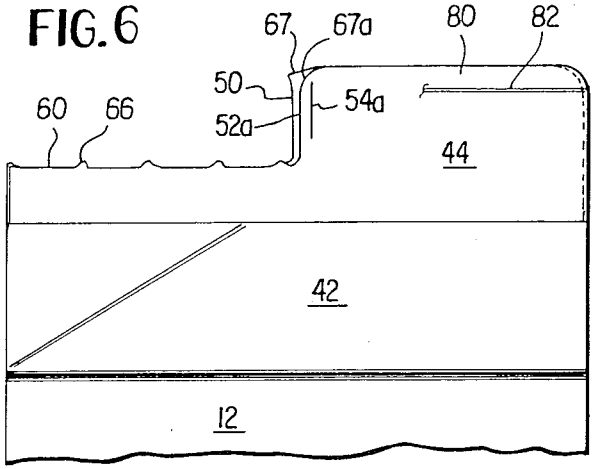
FIG. 6 is a view similar to FIG. 4, after the initial opening tearing has been completed.
Figure 7:
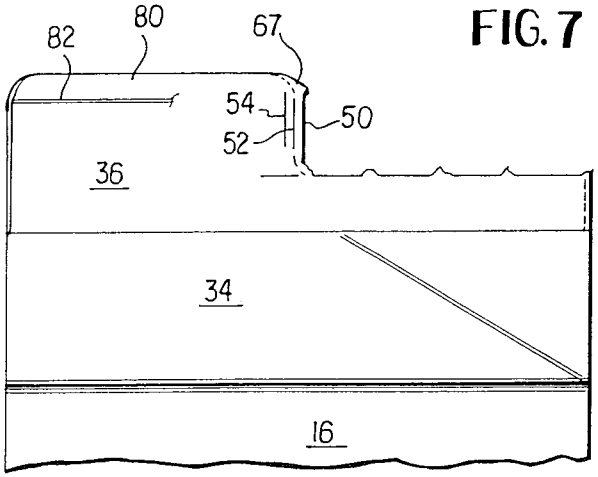
FIG. 7 is a view similar to FIG. 5, after the initial opening tearing has been completed.

In the example illustrated, vertical tearing can be effected by ripping along non homologous lines 52*a* and 50 as illustrated in FIGS. 6 and 7. Even though any opposite sided pair of the non homologous vertical cut lines may not be perfectly aligned, each will be close enough to the other so that vertical tearing can occur. The spacing between and number of vertical cuts 50, 50*a*, etc. in each panel portion 36 and 44 may be varied. A spacing equal to the thickness of the blank is typical and three such cut lines are usually sufficient.

This vertical ripping along at least substantially aligned opposite sided pairs of the vertically extending cut lines continues for a maximum vertical extent until respective edges of the tear edge perforations 60, 62 are encountered, this corresponding to the tear limiting cuts 66, 66*a* at each of the panel potions 36 and 44.

Thereafter, with the vertical fin tearing completed, the consumer, still grasping one half of the fin, rocks it back and forth, from side to side, until this half of the fin portion is removed along the tear edge perforations 60, 62 of each of panel portions 36 and 44. The torn away fin portion is of four thicknesses, except at its uppermost portion 80 where it is of two thicknesses. The four thicknesses are defined by the folded portions of panel portion 40 which are above cut lines 70 and by gable panel portions 36 and 44. Then, the pour spout is formed from the remaining portion of 40 (located below lines 70) in a conventional manner, namely, the two adjacent and V-shaped edges of that end of the carton nearest the reader in FIG. 3 are pulled apart, and the these edges are manipulated to unfold the pour spout. The slight slope of cut lines 70 in the pour spout panel portion 40 provides a flat pouring edge upon spout formation.

What is claimed is:

1. A unitary blank formed from stiff, foldable and resilient sheet material, such as paperboard, the blank adapted to be folded, erected, filled and sealed to form a gable top type carton for holding foodstuffs such as liquids, the blank being generally rectangular and provided with a plurality of score lines to define a plurality of panels, said panels including four serially joined, generally rectangular side forming panels, each having upper, lower and side edges, the lower edge of each side forming panel foldably carrying a bottom forming panel, the upper edge of each side forming panel foldably carrying a top closure forming panel, two of the latter panels being gusset panels, and the remaining two of said latter panels being gable panels, one of said gusset panels being a pour spout panel, said pour spout panel positioned between said gable panels, the gable panels being of a greater height than the gusset panels, a plurality of vertically extending cut lines, such of said cut lines commencing contiguous to the upper edge of each gable panel portion and extending vertically downwardly, said vertically extending cut lines being located near the midportion of the upper edge of each gable panel, a horizontal tear edge perforation line on each gable panel, each tear edge perforation line extending from the mid portion of its own respective gable panel to a location short of said pour spout forming gusset panel, whereby any of said vertically extending cut lines, on either gable panel, can function as a line of severence upon tearing of said gable panels after they are laminated together and to thereby compensate for misalignment of the gable panels when they are laminated together to form a vertically disposed fin.

2. The blank of claim 1 including a horizontally extending cut line on each gable panel contiguous to the lower ends of each plurality of vertically extending cut lines, to thereby limit the vertical extent of tearing.

3. The blank of claim 1 wherein said pour spout panel is provided with a substantially continuous inverted V shaped cut line extending thereacross whose ends are contiguous to and at the same level with one end of a respective tear edge perforation line.

4. The blank of claim 1 wherein one surface of said resilient sheet material is coated with a barrier layer material and wherein said cut lines and said tear edge perforation lines extend through said sheet material but not through said barrier layer material.

5. A gable top carton including two oppositely disposed gable panels, two oppositely disposed and inwardly folded gusset panels, one of the gusset panels adapted to be a pour spout, and a vertically disposed, laminated fin having two innermost layers defined by the folds of the gusset panels and two outermost layers defined by the gable panels, the improvement comprising, the two gable panels being of greater height than the two gusset panels and laminated together over said lines in each gable panel upper portion, each of said cut lines commencing contiguous to and below the upper edge of said panel upper portion, whereby edgewise misalignment of the gable panels will not inhibit the commencement of vertical tearing of the upper portions of the gable panels, by permitting tearing along non homologous cut lines of each gable panel upper portion.

6. The carton of claim 5 wherein a tear edge perforation line is carried by each gable panel upper portion and extends from a corresponding edge of said fin, substantially coextensive with said pour spout gusset panel, to at least adjacently beneath the vertically extending cut lines, whereby that portion of the fin bounded on two sides by the tear edge perforation lines and a generally oppositely disposed pair of said vertically extending cut lines can be removed to permit the pour spout to be opened to dispense the contents of the carton.

* * * * *

UNITED STATES PATENT AND TRADEMARK OFFICE

CERTIFICATE OF CORRECTION

PATENT NO. : 4,813,546

DATED : March 21, 1989

INVENTOR(S) : Robert L. Gordon et al

It is certified that error appears in the above-identified patent and that said Letters Patent is hereby corrected as shown below:

Column 6, lines 1-16

Claim 5 should read as follows:

5. A gable top carton including two oppositely disposed gable panels, two oppositely disposed and inwardly folded gusset panels, one of the gusset panels adapted to be a pour spout, and a vertically disposed, laminated fin having two innermost layers defined by the folds of the gusset panels and two outermost layers defined by the gable panels, the improvement comprising, the two gable panels being of greater height than the two gusset panels and laminated together over said greater height, a plurality of vertically disposed cut lines in each gable panel upper portion, each of said cut lines commencing contiguous to and below the upper edge of said gable panel upper portion, whereby edgewise misalignment of the gable panels will not inhibit the commencement of vertical tearing of the upper portions of the gable panels, by permitting tearing along non homologous cut lines of each gable panel upper portion.

Signed and Sealed this

Twenty-first Day of December, 1993

*Attest:*

Bruce Lehman

BRUCE LEHMAN

*Attesting Officer*

*Commissioner of Patents and Trademarks*